US005787326A

United States Patent [19]

Ogawa et al.

[11] Patent Number: 5,787,326

[45] Date of Patent: Jul. 28, 1998

[54] IMAGE FORMING APPARATUS HAVING A COVER FOR PROTECTING A TRANSFER REGION OF AN INTERMEDIATE TRANSFER MEMBER WHEN A DOOR IS OPENED

[75] Inventors: Katsutoshi Ogawa, Hirakata; Akira Kumon, Katano; Junichi Nawama, Toyonaka, all of Japan

[73] Assignee: Matsushita Electric Industrial Co., Ltd., Kadoma, Japan

[21] Appl. No.: 626,345

[22] Filed: Apr. 2, 1996

[30] Foreign Application Priority Data

Apr. 3, 1995 [JP] Japan ..... 7-077499

[51] Int. Cl.[6] ..... G03G 15/00

[52] U.S. Cl. ..... 399/124; 399/21; 399/121; 399/302; 399/390

[58] Field of Search ..... 399/21, 114, 121, 399/125, 302, 308, 316, 317, 390, 110, 345, 124

[56] References Cited

U.S. PATENT DOCUMENTS

| | | | |
|---|---|---|---|
| 4,588,280 | 5/1986 | Ogawa et al. | 399/114 |
| 5,041,872 | 8/1991 | Nukaya et al. | 399/110 X |
| 5,309,202 | 5/1994 | Haneda et al. | 399/114 |
| 5,390,010 | 2/1995 | Yamahata et al. | 399/308 |
| 5,565,975 | 10/1996 | Kumon et al. | 399/302 |
| 5,587,769 | 12/1996 | Sawada et al. | 355/400 |

FOREIGN PATENT DOCUMENTS

| | | |
|---|---|---|
| 0 507 528 | 10/1992 | European Pat. Off. . |
| 0 643 338 | 3/1995 | European Pat. Off. . |
| 3323086 | 12/1983 | Germany . |
| 56-149075 | 11/1981 | Japan . |
| 59-127073 | 7/1984 | Japan . |
| 59-155871 | 9/1984 | Japan . |
| 59-183276 | 7/1990 | Japan . |
| 4085575 | 3/1992 | Japan . |
| 4093978 | 3/1992 | Japan . |
| 5-072910 | 3/1993 | Japan . |
| 5-323704 | 12/1993 | Japan . |
| 6-019331 | 1/1994 | Japan . |
| 6-019332 | 1/1994 | Japan . |
| 7-013445 | 1/1995 | Japan . |

*Primary Examiner*—Arthur T. Grimley
*Assistant Examiner*—Sophia S. Chen
*Attorney, Agent, or Firm*—Wenderoth, Lind & Ponack

[57] ABSTRACT

In a color electrophotographic printer, an intermediate transfer belt is provided to layer toner images of a plurality of colors, and the toner images on the belt are transferred onto a paper sheet. In order to remove a paper sheet when a paper jam happens, a door is provided in a case of the printer, while a cover is provided to protect a transfer region where the intermediate transfer belt contacts with a paper sheet for transferring the toner images. When the door is opened, the cover moves to cover a portion of the surface of the intermediate transfer belt exposed to the door. When the jammed paper sheet is removed, the image forming process is resumed immediately on the toner images on the intermediate transfer belt. Further, an intermediate transfer unit including the intermediate transfer belt and the cover detachable from the printer may be provided. In a modified example, a transfer member which is connected to a transfer member is provided instead of the cover, and when the door is opened, the transfer member covers the surface of the intermediate transfer belt.

15 Claims, 9 Drawing Sheets

IMAGE FORMING APPARATUS HAVING A COVER FOR PROTECTING A TRANSFER REGION OF AN INTERMEDIATE TRANSFER MEMBER WHEN A DOOR IS OPENED

BACKGROUND OF THE INVENTION

1. Field of the Invention

The present invention relates to an image forming apparatus such as a copying machine, a printer or a facsimile machine, or in particular to a color image forming apparatus.

2. Description of the Prior Art

Recently, tools for forming a color document image have become popular rapidly, and an apparatus such as a printer or a copying machine is needed more and more for forming a color image on a paper sheet. A color image forming apparatus using electrophotography has advantages such as versatility of a kind of a paper sheet and superiority on forming a half-tone image, and it has been developed intensively.

In an electrophotographic process, an electrostatic latent image is formed on a photoreceptive drum, and a toner image is formed on the latent image. There are various types of color image forming apparatuses, as disclosed, for example, in Japanese Patent laid open Publications 6-19,331/1994, 59-155,871/1984, 7-13,445/1995 and 2-183,276/1990. The invention relates to an intermediate transfer process wherein a plurality of color toner images are superposed on an intermediate transfer material, and they are transferred onto a paper sheet collectively. This process has many advantages. For example, a complicated mechanism is not needed for handling a paper sheet. It is possible to produce an apparatus compactly, thus decreasing costs and making maintenance easy. Further, superposition of toner images on the intermediate transfer material does not affect development characteristics.

However, the intermediate transfer process has two problems with respect to clearing a paper jam. First, let us assume that a paper jam occurs before the paper arrives in a transfer region while toner images are held on the intermediate transfer material. If a user touches and disturbs the toner image while removing the paper jam, the toner images become useless, and many problems arise. For example, the toner images have to be removed from the intermediate transfer material and toner images have to be formed again from a toner image of the first color, so that it takes a long time until a normal color image is output. Further, toners are consumed excessively, and the amount of waste toner increases. Because times of cleaning the intermediate transfer material increases, and this decreases a life of the cleaner.

In order to solve these problems, it was proposed in Japanese Patent laid open Publication 5-323,704/1993 to provide a new path for carrying the jammed paper sheet while the latent image and the toner image continue to be formed and transferred on the intermediate transfer material. However, this increases the size of the apparatus. Further, even if the new path is provided, a user has to remove the jammed paper by inserting his or her hand into the apparatus. Then, the problem of touching the toner images on the intermediate transfer material while removing the jammed paper is not decreased.

Another problem is that when a jammed paper is removed by a user, a hand of the user or the jammed paper may touch the intermediate transfer material, and this deteriorates the intermediate transfer material. If hand grease adheres to the intermediate transfer material, toners transferred onto the hand grease tends to adhere to the hand grease, so that transfer efficiency to a paper sheet decreases at the region. Then, a trace of touching with the hand is included in the toner image. Further, if the intermediate transfer material has a shape of a belt, when the hand grease is absorbed in the belt through a hole provided for detecting the position of the belt, the strength of the intermediate transfer material decreases partially, and the accuracy of the size thereof is deteriorated. Further, if the jammed paper touches the intermediate transfer material, the former is liable to damage the latter.

In order to solve this problem, it was proposed in Japanese Patent laid open Publication 5-72,910/1993 to release a paper feed path around the timing rollers in a region where a hand is inserted for removing a jammed paper and to provide a protection means for protecting the intermediate transfer material. However, in this method, it is difficult to extend protection to a transfer region where the intermediate transfer material transfers toner images onto a paper sheet.

SUMMARY OF THE INVENTION

An object of the present invention is to provide an image forming apparatus which protects an intermediate transfer member when a paper jam is cleared.

Another object of the present invention is to provide an image forming apparatus which is easy to maintain.

In one aspect of the invention, an image forming apparatus for forming an image on a paper sheet uses electrophotograpy process. A toner image developed by a development member is transferred on an intermediate transfer member, and a first transfer member transfers the toner image held on a photoreceptor onto the intermediate transfer member. Further, a second transfer member transfers the toner image held on the intermediate transfer member onto a paper sheet carried by a paper feed system. An opening for clearing a paper sheet jammed in the paper feed system is provided in a case containing the above-mentioned components, and a door closes the opening of the case. The second transfer member is mounted to an inside of the door, while the second transfer member is set at a position near the intermediate transfer member to transfer the toner images onto the paper sheet fed by the paper feed system when the door is closed and is separated from the intermediate transfer member when the door is opened. A cover is provided to cover a portion of the intermediate transfer member which is exposed to the opening of the case when the door is opened, and a member, engaged with the door, moves the cover to cover the portion of the intermediate transfer member exposed to the opening when the door is opened and retracts the cover from the portion when the door is closed. Thus, when the door is opened, the surface of the intermediate transfer member opposing a paper feed path is covered with the cover, so that the surface of the intermediate transfer member is protected even when the door is opened. The intermediate transfer member, the cover and the member for moving and retracting the cover may be integrated as a unit which can be detached through the opening of the case.

In a second aspect of the invention, the image forming apparatus comprises a secondary transfer member as in the first aspect of the invention, but the secondary transfer member is protected, without using the cover, but by using a member which separates the second transfer member from the intermediate transfer member when the door is opened. Preferably, a charge removing member for removing charges from a back of a paper sheet is also supported by the member which separates the second transfer member. The intermediate transfer member, the second transfer member and the member for separating the second transfer member may be integrated as a unit which can be detached through the opening of the case.

An advantage of the present invention is that image forming process is resumed readily after paper jam is cleared.

Another advantage of the present invention is that maintenance of the intermediate transfer member and the like is easy.

BRIEF DESCRIPTION OF THE DRAWINGS

These and other objects and features of the present invention will become clear from the following description taken in conjunction with the preferred embodiments thereof with reference to the accompanying drawings, and in which.

DETAILED DESCRIPTION OF THE PREFERRED EMBODIMENTS

Figure 1:
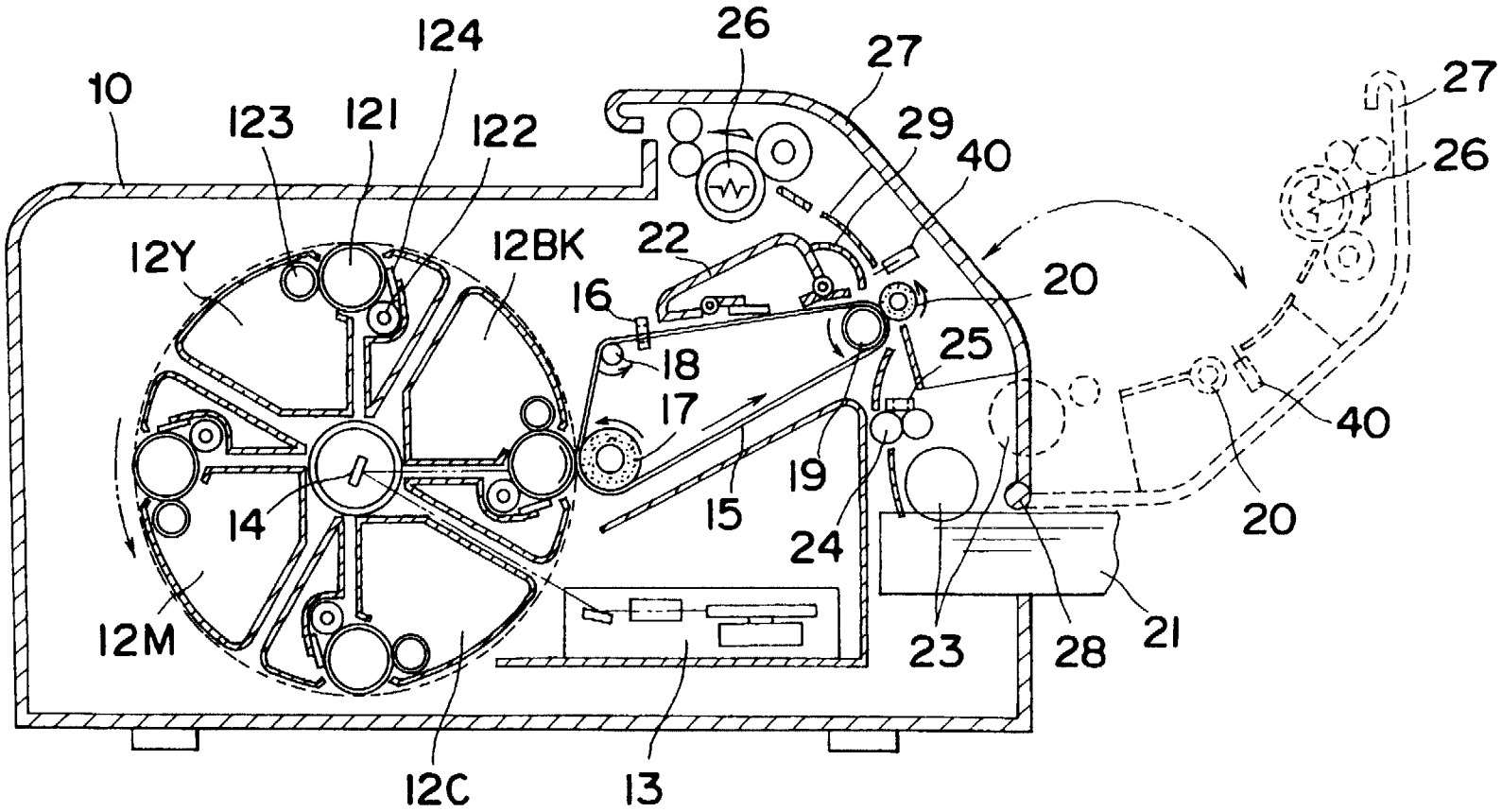
FIG. 1 is a schematic sectional view of a color image forming apparatus of a first embodiment of the invention.

Referring now to the drawings, wherein like reference characters designate like or corresponding parts throughout the views, FIG. 1 shows a color image forming apparatus of a first embodiment of the invention. A group of image forming units 12 comprises units 12Y, 12M, 12C and 12BK for yellow, magenta, cyan and black, and each unit comprises a photoreceptive drum 121, a charging device 122, a development device 123 and a cleaning device 124. The photoreceptive drum 121 comprises an aluminum base having a diameter of 30 mm and a thickness of 1 mm, and an organic photoconductor layer of a thickness of 20 μm coated on the aluminum base. The charging device 122 comprises a roller, and it charges the photoreceptive drum 121 negatively by following the movement of the photoreceptive drum 121. The development device 123 includes a two-component development material made of nonmagnetic toners and carriers. In this embodiment, the charging potential of the drum 121 is −700 V, the exposure potential thereof is −100 V, and a toner image is formed with the development voltage of −500 V.

The four image forming units 12Y, 12M, 12C and 12BK rotate around a center thereof along a counterclockwise direction as shown with an arrow in FIG. 1. When one of the units (12BK in FIG. 1) is moved at an image forming site, the development device 123 is located at an upper side, while the cleaning device 124 is located at a lower side in the unit. In the image forming site, an exposure unit 13 emits a beam through a unit between the cleaning unit 124 and the development device in the adjacent unit. Then, the beam is reflected by a mirror 14 fixed at the rotation center of the image forming units 12 to expose the photoreceptive drum 121.

An intermediate transfer belt 15 is made of a polycarbonate resin wherein electrically conductive carbon particles are dispersed. It has a resistivity of about $10^9$ Ω.cm. The belt 15 has a loop length of 377 mm which can hold an image of A4 size and a thickness of about 150 μm. The 10 points meaning roughness of the belt is about 3–5 μm. The belt 15 is suspended by a primary transfer roller 17, a stretch roller 18 and a drive roller 19. The drive roller 19 is driven to rotate the belt 15 by a motor not shown. A transfer voltage is applied to the primary transfer roller 17. A secondary transfer roller 20 contacts through the belt 15 to the drive roller 19 to transfer a toner image on the belt 15 onto a paper sheet 21. A cleaning unit 22 is provided to remove toners remained on the intermediate transfer belt 15 after transfer onto the paper sheet. Further, a cover 29 is provided between the secondary transfer roller 20 and the cleaning unit 22 in the downstream side with respect to the transfer region, and the cover 29 will be explained in detail later.

A sensor 16 comprises a light emitting element and a photosensor, and the sensor 16 is set around the intermediate transfer belt 15 to detect a slit provided in an edge of the belt 15 for controlling a timing to form an electrostatic latent image on the photoreceptive drum 121.

A paper sheet 21 is feed from a tray by a paper feed roller 23 through a guide member to a pair of timing rollers 24, which supplies the paper sheet 21 synchronously with image signals through another guide member to a transfer region. A paper jam sensor 25 is positioned at the upstream side along a paper feed direction with respect to the transfer region where the intermediate transfer belt 15 contacts the secondary transfer roller 20, while a charge removing needle 40 is provided at the downstream side. The paper sheet is carried to a fuser 26 where the toner image is fixed, and it is carried out to the external of the image forming apparatus.

The above-mentioned components of the image forming apparatus are contained in a case 10. The case 10 has an opening for clearing paper jam, and the opening is closed by a door 27. The door 27 is rotated at a hinge 28 along a direction perpendicular to the longitudinal direction of the photoreceptive drum 121 in order for a user to access the inside of the case 10. As shown with dashed lines, components such as the paper feed roller 23, the timing toller 24, the secondary transfer roller 20, the charge removing needle 40, the fuser 26 and guide members for guiding a paper sheet, are integrated with the door 27 on the inside of the door 27. When a paper jam happens and the door 27 is opened, a part of the paper feed path is exposed to the opening or to a user. Then, a space in which the user inserts his or her hand becomes wide for clearing the paper jam, and it becomes easy to remove the jammed paper.

Next, the cover 29 for protecting the intermediate transfer belt 15 is explained in detail. The cover 29 cooperates with the door 27. When the door 27 is opened, the cover 29 moves to cover the transfer region where the intermediate transfer belt 15 contacts with a paper sheet. The cover 29 has a curved shape to cover the belt 15 around the drive roller 19.

When the door 27 is closed, the cover 29 moves above a side of the cleaning device 22 as a guide member for carrying the paper sheet in the downstream side with respect to the secondary transfer roller 20.

Figure 2:
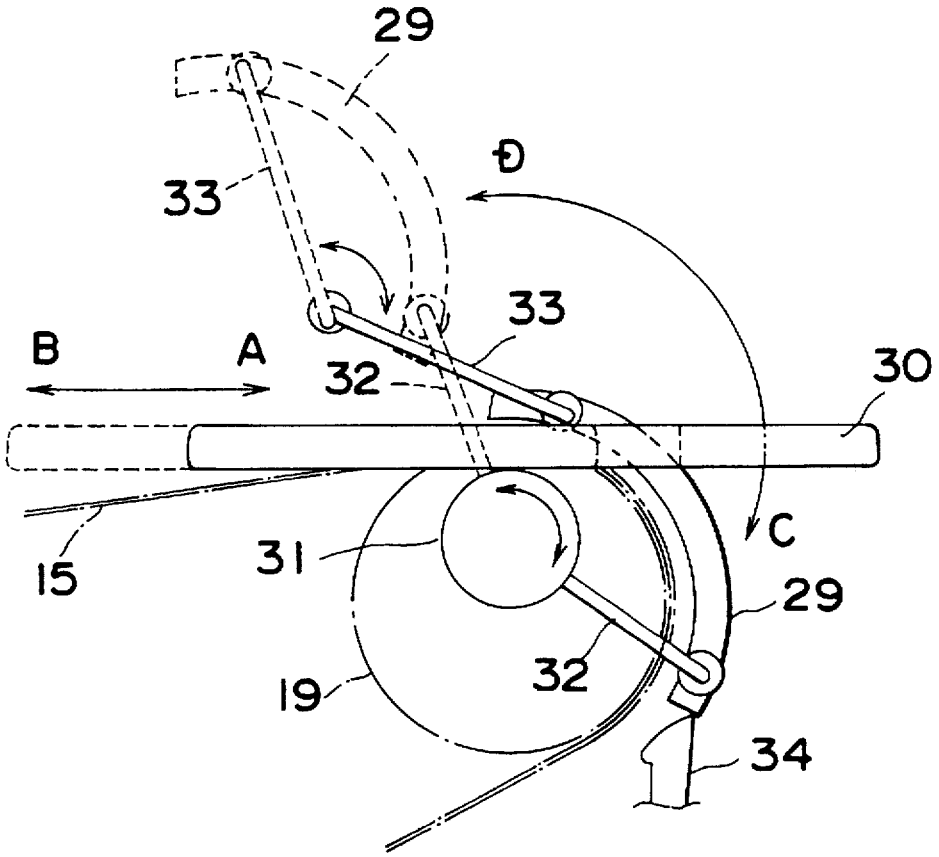
FIG. 2 is a schematic sectional view of an opening mechanism for a protection cover of the first embodiment.

FIG. 2 shows a mechanism of opening and closing the cover 29. When the door 27 is closed, the arm 30 touched by the inside of the door 27 at the right side in FIG. 2 is forced to move along a direction "B" to a close position represented with dashed lines. On the other hand, when the door 27 is opened, the arm 30 connected to a spring (not shown) is pushed back by the spring along a reverse direction "A" to an open position represented with solid lines.

The arm 30 engages with a rotary gear 31 provided at a side of the drive roller 19. A first lever 32 is fixed to the gear 31 at an end thereof, while it is connected at the other end thereof to an edge of the cover 29 so as to be allowed to be rotated. A second lever 33 is connected at an end thereof to the other end of the cover 29 and at the other end thereof to the case 10 both so as to be allowed to be rotated. Then, when the door 27 is opened or closed, the gear 31 is rotated clockwise or counterclockwise, and the cover 29 moves from the close position (dashed lines) to the open position (solid lines) and vise versa along a direction "C" or "D". The cover 29 collides with a stopper 34 when it moves along the direction "C", so that it is prevented for the cover 29 to move further downward.

It is to be noted that the surface of the intermediate transfer belt 15 are all covered with fixed components except a region to be covered by the cover 29 in the open position, and the region is covered by the cover 29. Therefore, all the surfaces of the belt 15 are covered when the door 27 is opened and a user views the inside of the case 10.

Next, electrophotographic process for printing a color image is explained. The color image is printed with toners of black (BK), cyan (C), magenta (M) and yellow (Y). First, the image forming units 12 are rotated to make it possible to expose the surface of the photoreceptive drum 121 of the image forming unit 12BK for black. In the image forming unit 12BK, a toner image is formed with charging, exposure with a light beam and development, as known for a black and white printer. The black toner image is transferred onto the intermediate transfer belt 15 by applying a transfer voltage to the primary transfer roller 17. While the toner image is transferred on the belt 15, an entrance seal and a cleaning blade of the cleaning device 22 and the secondary transfer roller 20 are separated from the surface of the intermediate transfer belt 15.

When the black toner image is transferred onto the intermediate transfer belt 15 completely, the image forming units 12 are rotated again so that the image forming unit 12C for cyan is located at the exposure position. Then, the unit 12C forms a toner image of cyan on the photoreceptive drum 121 similarly to the unit 12BK. On the other hand, the intermediate transfer belt 15 starts to rotate synchronously with a front position of the black toner image thereon, and a transfer voltage is applied to the primary transfer roller 17. Thus, the cyan toner image is layered on the black toner image. Similarly, a toner image of magenta is put on the cyan and black toner images.

A toner image of the last color, yellow, is formed and put on the toner images of the three colors on the intermediate transfer belt 15. On the other hand, a paper sheet 21 which has been carried to the timing rollers 24 is started by the timing rollers 24 to carry the paper sheet synchronously to the front position of the toner images on the intermediate transfer belt 15. A paper jam is detected when the paper jam sensor 25 does not detect the paper sheet.

The toner images on the intermediate transfer belt 15 is transferred onto the paper sheet when it passes the transfer region where the intermediate transfer belt 15 contacts with the secondary transfer roller 20. Then, the toners on the paper sheet 21 are fixed by the fuser 26, and the paper sheet 21 is discharged to the outside of the case.

Then, the secondary transfer drum 20 is separated from the intermediate transfer belt 15, and the transfer voltage applied to the transfer roller 20 is turned off. Further, the entrance seal and the cleaning blade of the cleaning device 22 are also separated from the intermediate transfer belt 15. The image forming units 12 are rotated and stopped in a state not in contact with the intermediate transfer belt 15. Then, the intermediate transfer belt 15 is kept in a state not in contact with the photoreceptive drum 121 and the secondary transfer roller 20 while the apparatus is not operated.

Next, it is explained how a paper jam is dealt with. It is assumed here that a paper jam happens after the magenta toner image is formed and before the yellow toner image is formed. Then, the toner images of black, cyan and magenta are held on the intermediate transfer belt 15. When the paper jam is detected by the sensor 25, all devices such as the photoreceptive drum 121, the secondary transfer roller 20 and components of the cleaning device 22 which contact with the intermediate transfer belt 15 are separated therefrom, and the driving of the apparatus is stopped.

Then, as a user opens the door 27, the load on the spring (not shown) connected to the arm 30 is released, and the arm 30 moves along the direction "A" in FIG. 2 to drive the gear 31. Thus, the levers 32 and 33 rotate to move the cover 29 along the direction "C" in FIG. 2 from the position illustrated by the dashed lines to the other position illustrated with solid lines. Thus, all the surfaces of the intermediate transfer belt 15 opposing the paper feed path for a paper sheet is covered, so that user's hand or the jammed paper sheet does not touch the surface of the intermediate transfer belt 15 when the jammed paper sheet is removed from the case 10 of the apparatus. Therefore, the user's hand does not contaminate the belt 15 with hand grease, and the jammed paper sheet does not damage the belt 15 when it is removed. Further, the surface of the toner images held on the intermediate transfer belt 15 are kept not disturbed, and an yellow image forming process which has been interrupted is started again readily.

After the jammed paper sheet is removed, the user closes the door 27. Thus, the arm 30 moves in the direction "D" in FIG. 2 to rotate the gear 31. Then, the levers 32 and 33 rotate reversely to move the cover 29 along the direction "C" in FIG. 2 from the position illustrated by the solid lines to the other position illustrated with dashed lines. Thus, a surface of the intermediate transfer belt 15 is uncovered again.

Then, the image forming unit 12Y for yellow resumes image forming for yellow readily on the toner images of the three preceding colors, without restarting the formation of the black toner image. First, the toner image held on the photoreceptive drum 121 in the image forming unit 12Y is removed by the cleaning device 122. On the other hand, the intermediate transfer belt 15 is rotated for position synchronization, while the photoreceptive drum 121 in the image forming unit 12Y for yellow, the secondary transfer roller 20 and the cleaning device 122 do not contact with the belt 15. Then, an yellow toner image is started to be formed on the photoreceptive drum 121 by the image forming unit 12Y, and it is transferred onto the toner images of the three colors on the intermediate transfer belt 15, while a paper sheet 21 is fed without any paper jam. Then, the toner images are transferred onto the paper sheet 21 by the secondary transfer roller 20, and they are fixed by the fuser 26. Thus, a color image of the four colors is formed on the paper sheet. Because the image forming process is restarted from the state when the paper jam happens, a time for image forming is not elongated so long. Further, because the image forming is restarted on the toner images held on the intermediate transfer belt 15, toners are not consumed wastefully. Further, because the surface of the intermediate transfer belt 15 is protected by the cover 29, the life of the belt 15 is not shortened by the user.

The cover shown in FIG. 2 uses the two levers 32, 33 supported at two points for moving it from the close position to the open position. However, any other mechanism may be adopted to move the cover 29 between the two positions. For example, the cover 29 may slide between the two positions.

Figure 3:
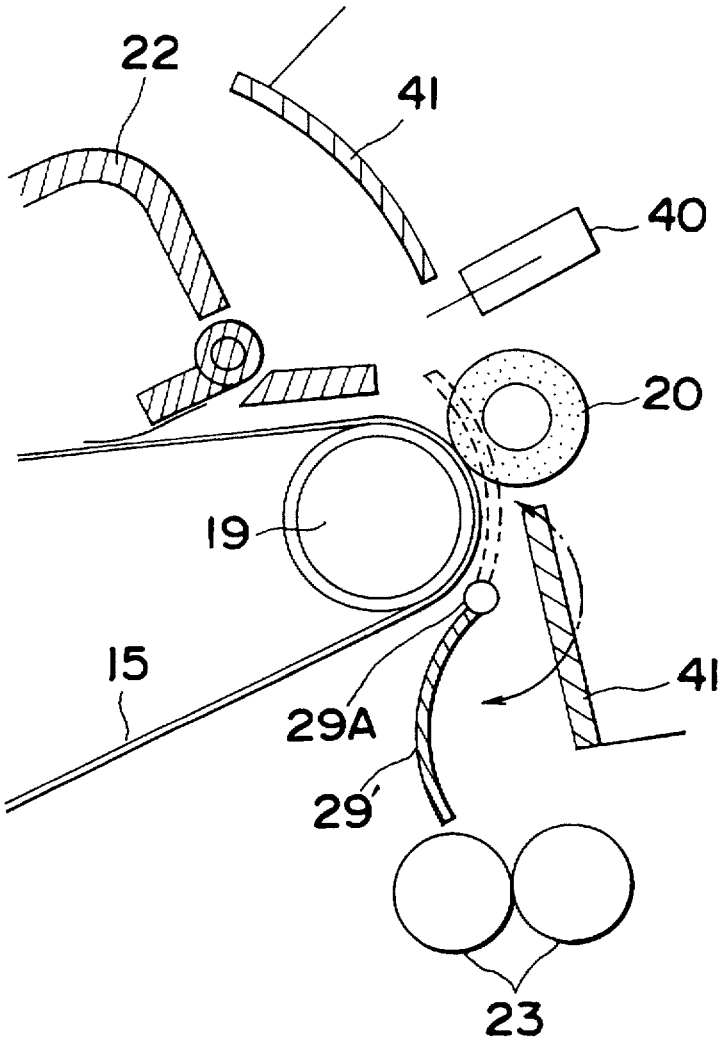
FIG. 3 is a schematic sectional view of an opening mechanism for a protection cover of a modified example of the first embodiment.

FIG. 3 shows a modified example of the cover 29' which acts as a guide member for guiding a paper sheet in the upstream side of the paper feed path with respect to the secondary transfer roller 20 while the door 27 is closed. FIG. 3 shows the cover 29' in the close position illustrated with solid lines when the door 27 is closed and in the open position illustrated with dashed lines when the door 27 is opened. The cover 29' has an axis 29A for rotating it. When the door 27 is opened by a user, the secondary transfer roller 20, the charge removing needle 40 and the guide members 41 all fixed to the door 27 are also removed from the transfer region, while the cover 29' is moved around the axis 29A to the open position in the transfer region in order to protect the intermediate transfer belt 15. A space around the timing rollers 24 becomes wide eventually, so that a user can insert his or her hand easily for clearing paper jam, and it becomes easier to clear paper jam.

Figure 4:
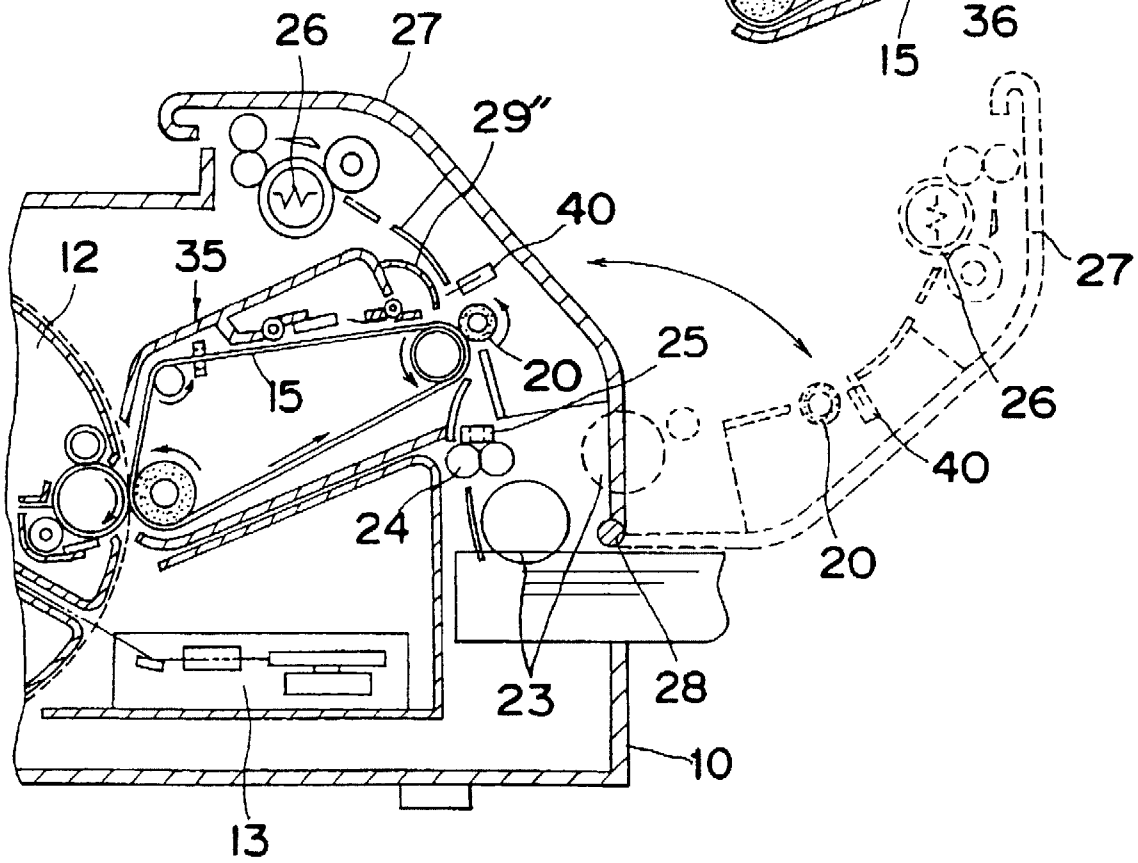
FIG. 4 is a schematic sectional view of a color image forming apparatus of a second embodiment of the invention.

FIG. 4 shows a color image forming apparatus of a second embodiment of the invention. This apparatus is different from that of the first embodiment only in that an intermediate transfer unit 35 is used. Dashed lines represent the door 27 in an open state. The intermediate transfer unit 35 is detachable and can be removed by a user through the opening of the case 10 to the outside, as shown at the top rightmost side in FIG. 4. A case 36 of the unit 35 includes an intermediate transfer belt 15, a primary transfer roller 17', a stretch roller 18' and a drive roller 19' suspending the belt 15 and integrates them as a detachable unit. Axes of these rollers 17', 18' and 19' are supported by the case 36. A cleaning device 22' is also provided in the case 36 opposing the belt 15. A cover 29" is also supported by the case 36, and it has a mechanism similar to that shown in FIG. 2 such as the arm 30, the gear 31, the levers 32, 33 and the stopper 34 though not shown explicitly in FIG. 4 for the simplicity of explanation. The levers 32, 33 and the like are also supported by the case 35. When the door 27 is opened, the cover 29" moves from the close position shown at the center in FIG. 4 to the open position shown at the top rightmost side in FIG. 4. The case 36 has an opening near the first transfer roller 17' besides the transfer region near the second transfer roller 20 to be covered by the cover 29".

It is an advantage of the embodiment that maintenance becomes easier because only the unit 35 is needed to be changed when the intermediate transfer unit 35 is deteriorated, for example, when the intermediate transfer belt 15 is deteriorated or when wasted toners become abundant. When the unit is detached, the cover 29" protects the belt 15, and it is prevented for the belt to be deteriorated by touching or damaging the belt 15.

As shown in FIG. 4, the case 36 has an opening near the first transfer roller 17' besides the region near the second transfer roller to be covered by the cover 29". However, it is preferable to cover this opening by a similar cover. Then, the intermediate transfer belt 15 is protected more reliably.

Figure 5:
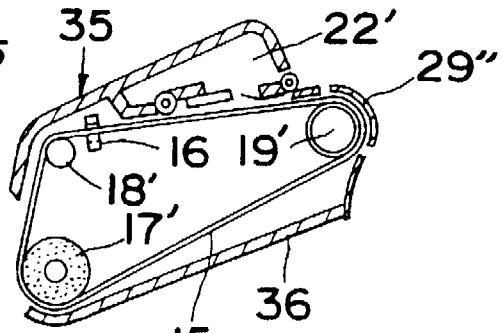
FIG. 5 is a schematic sectional view of an intermediate transfer unit of the second embodiment of the invention.
Figure 6:
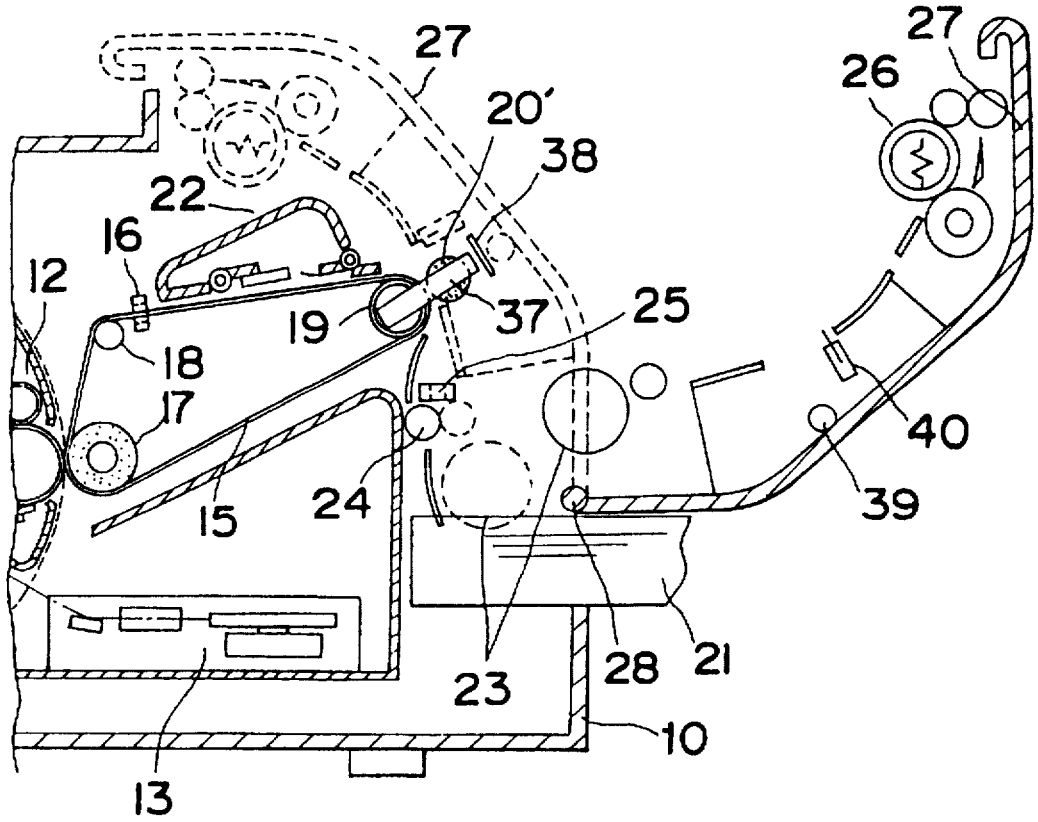
FIG. 6 is a schematic sectional view of a color image forming apparatus of a third embodiment of the invention.
Figure 6A:
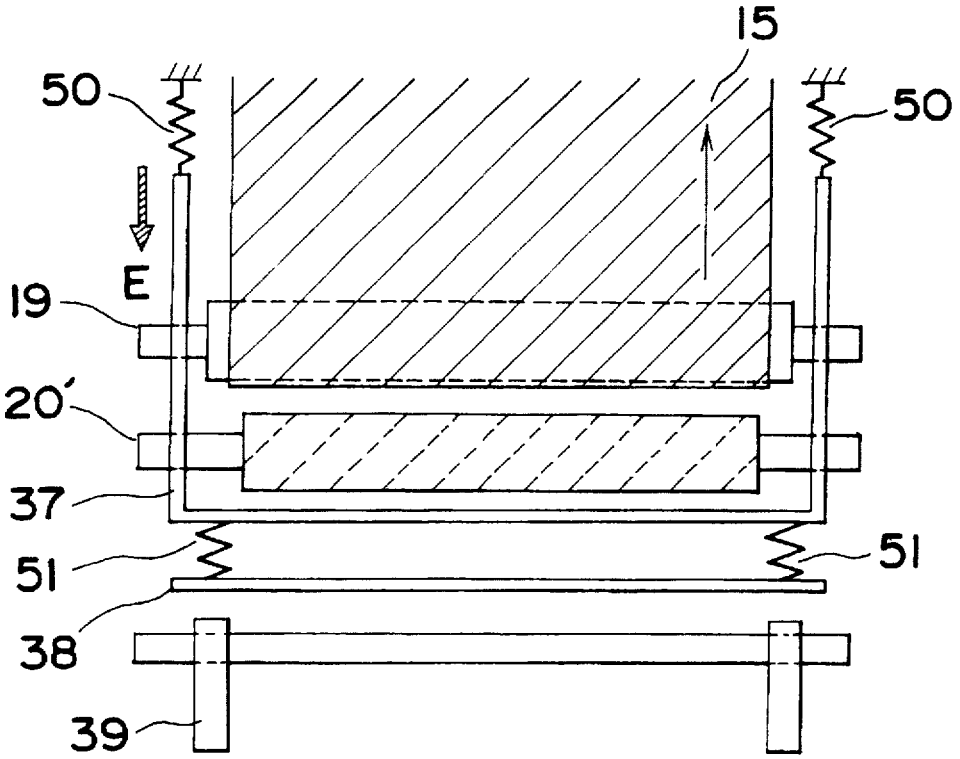
FIGS. 6A and 6B are diagrams for explaining the operation of a device for moving a secondary transfer member.
Figure 6B:
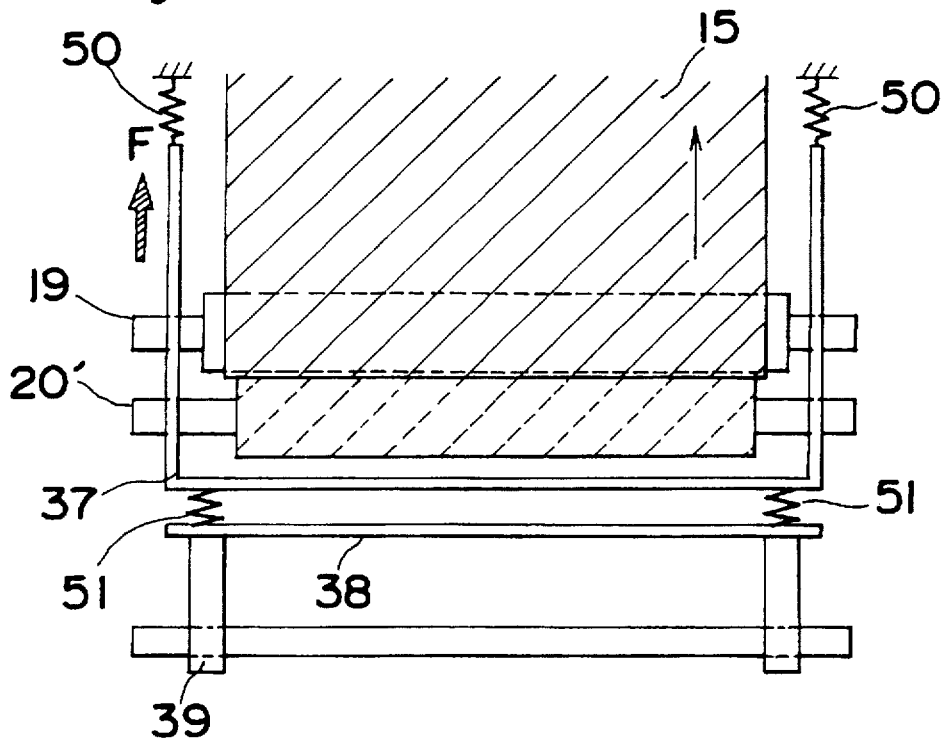

FIG. 5 shows an image forming apparatus of a third embodiment of the invention. This apparatus does not use the cover 29 of the first embodiment, and it is different from that of the first embodiment only around the transfer region. Solid lines represent the door 27 in an open state. A secondary transfer roller 20' opposes the drive roller 19 which drives the intermediate transfer belt 15. The secondary transfer roller 20' is mounted to a holder 37 connected to a case 36. The holder 37 moves the roller 20' with respect to the drive roller 19 perpendicularly to the longitudinal direction thereof. FIGS. 6A and 6B show the operation of the holder 37 when the intermediate transfer belt 15 is separated from the secondary transfer roller 20' and when the belt 15 contacts with the roller 20'. As shown in FIGS. 6A and 6B, springs 50 are connected to the holder 37 so that a force exerts along the direction "E" to separate the secondary transfer roller 20' from the drive roller 19. A holder base 38 is connected through springs 51 to the holder 37, while a cam 39 mounted to the inside of the door 27 can contact with the holder base 38 when the door 27 is closed. In the state shown in FIG. 6A, the intermediate transfer belt 15 is separated from the secondary transfer roller 20', and a distance between the secondary transfer belt 15 and the secondary transfer roller 20', 2 mm in this example, is set so that the surface of a toner image on the belt 15 does not contact with the roller 20'.

Next, the operation of the secondary transfer roller 20' is explained. As shown in FIG. 6A, when an image is formed, the cam 39 is rotated to a position not to contact with the holder base 38. Then, the springs 50 moves the holder 37 along the direction "E". Then, the secondary transfer roller 20' is kept to be separated from the intermediate transfer belt 15.

A paper jam is decided to happen when the sensor 25 does not detect a paper sheet just before the start of the transfer onto the paper sheet. When a paper jam happens, the operation of the image forming apparatus is stopped. While the jammed paper is removed, the secondary transfer roller 20' is kept to be separated from the intermediate transfer belt 15, as shown in FIG. 6A.

After paper jam is cleared, the apparatus is restarted. When the sensor 25 detects a paper sheet, the cam 39 rotates to contact with the base bottom of the holder base 38. Thus, as shown in FIG. 6B, the holder 37 slides along the direction "F" so that the secondary transfer roller 20' contacts with the intermediate transfer belt 15. At the same time, a transfer voltage is applied to the secondary transfer roller 20'. After the transfer of the toner image onto the paper sheet is completed, the cam 39 rotates again to be separated from the bottom plane of the holder base 38, as shown in FIG. 6A, and the secondary transfer roller 20' is separated from the intermediate transfer belt 15.

The secondary transfer roller 20' described above has an advantage that transfer is performed more stably. In the image forming apparatus of the first embodiment shown in FIG. 1, the secondary transfer roller 20 fixed to the door 27 contacts with the intermediate transfer belt 15 with reference to the hinge for rotating the door 27. Then, if the precision of the axis is low or the axis is not set so precisely along the right and left direction, the pressure between the intermediate transfer belt 15 and the secondary transfer roller 20 becomes nonuniform along the longitudinal direction of the roller 20. Then, the transfer efficiency may become uneven on the paper sheet, or lines or characters in the image may be hollowed around the right or left end of the paper sheet. Further, as the door 27 is closed repeatedly, the hinge wears, and this worsens the accuracy. On the contrary, the secondary transfer roller 20' of this embodiment is set with reference to the position of the intermediate transfer belt 15. Therefore, the roller 20' is separated from the belt 15 with reference to the position of the belt 15. Thus, the pressure between the intermediate transfer belt 15 and the secondary transfer roller 20' becomes uniform along the longitudinal direction of the roller 20'. Thus, the above-mentioned disadvantages are prevented.

In a modified example, a guide member arranged at the upstream side along the paper feed path with respect to the transfer region is attached to the holder 37. Then, a larger area of the intermediate transfer belt 15 is covered by the holder 37, or a toner image on the belt 15 is protected in a wider area. Further, because the guide member is arranged with reference to the belt 15, a distance thereof to the belt 15 is kept constant along the longitudinal direction. Then, the guide member does not collide with a sheet paper nonuniformly, and a paper jam before a paper sheet arrives the transfer region may be reduced to happen.

Figure 7:
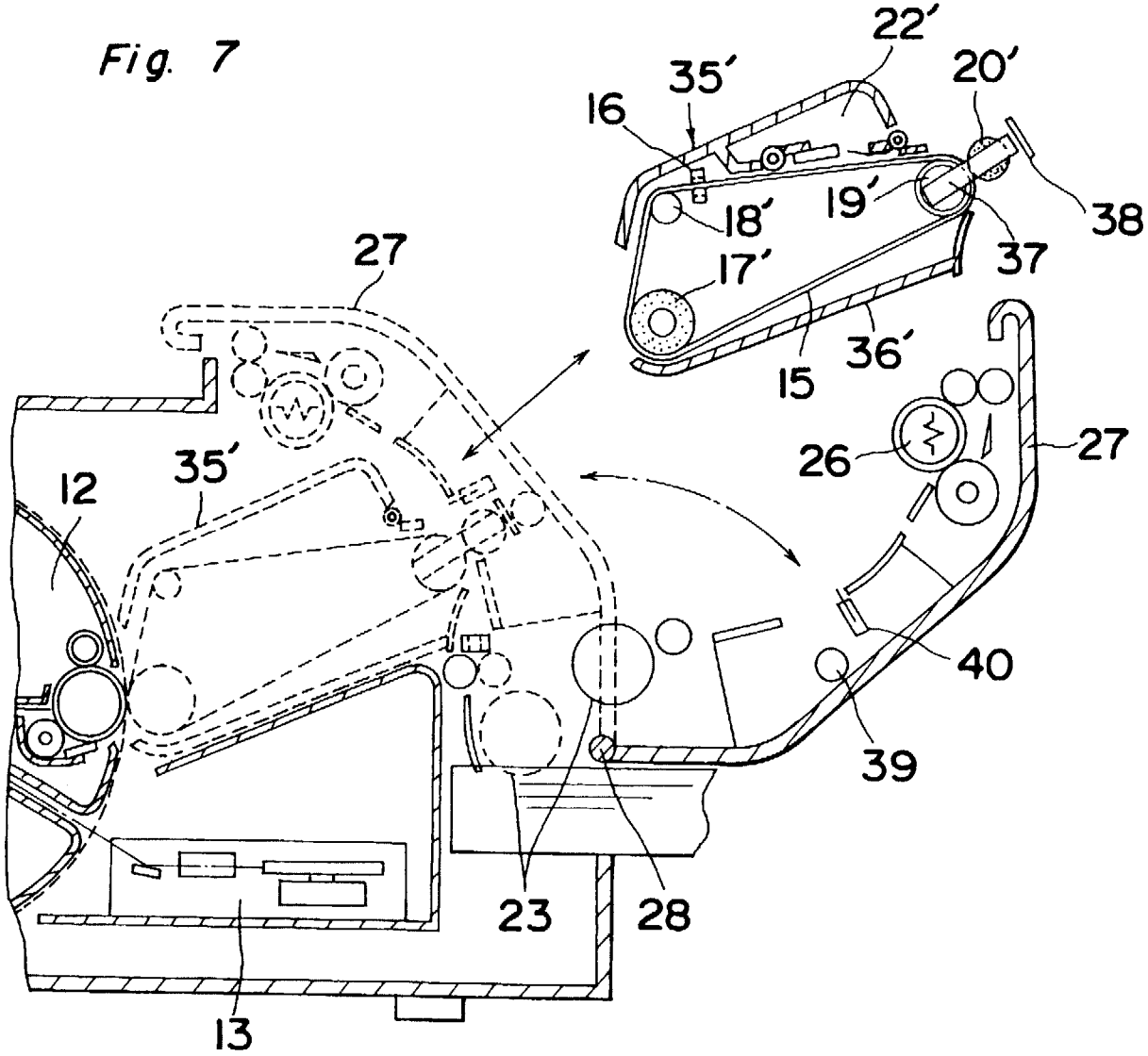
FIG. 7 is a schematic sectional view of a color image forming apparatus of a fourth embodiment of the invention.

FIG. 7 shows a color image forming apparatus of a fourth embodiment of the invention. This apparatus is different from that of the third embodiment only in that an intermediate transfer unit 35', detachable from a main part of the image forming apparatus, is used similarly to the unit 35 in FIG. 4. The intermediate transfer unit 35' can be detached by a user through the opening of the case 10 to the outside, as shown at the top rightmost side in FIG. 7 illustrated with solid lines. Dashed lines represent the door 27 in a close state and the intermediate transfer unit 35' in a state installed in the main body of the apparatus. The intermediate transfer unit 35' is different from the counterpart 35 of the second embodiment in that the secondary transfer roller 20' and relevant components are integrated instead of the cover 29. A case 36' of the unit 35' includes an intermediate transfer belt 15, a primary transfer roller 17', a stretch roller 18' and a drive roller 19' suspending the belt 15. Axes of these rollers 17', 18' and 19' are supported by the case 36'. A cleaning device 22' is also integrated in the case 36' opposing the belt 15. The holder 37 is supported by said case 36', and other components such as the holder base 38 and the springs 50, 51 are also included similarly to those shown in FIGS. 5 and 6 though not shown explicitly in FIG. 7 for the simplicity of explanation. The springs 50 are supported by the case 35'. When the door 27 is opened, the holder 37 moves from the close position shown in FIG. 6B to the open position shown in FIG. 6A.

When the intermediate transfer unit 35' is detached from the image forming apparatus, the intermediate transfer belt 15 around the transfer region is covered with the secondary transfer roller 20', the holder 37 and the holder base 38. As far as a load is not applied to the holder base 38, there is a space between the intermediate transfer belt 15 and the secondary transfer roller 20'. Thus, it becomes easier for maintenance to change the intermediate transfer belt 15 or the secondary transfer roller 20'.

As shown in FIG. 7, the case 36' has an opening near the first transfer roller 17'. However, it is preferable to cover this opening by a cover similar to the cover 29 shown in FIG. 2 in order to protect the intermediate transfer belt 15 further.

Figure 8:
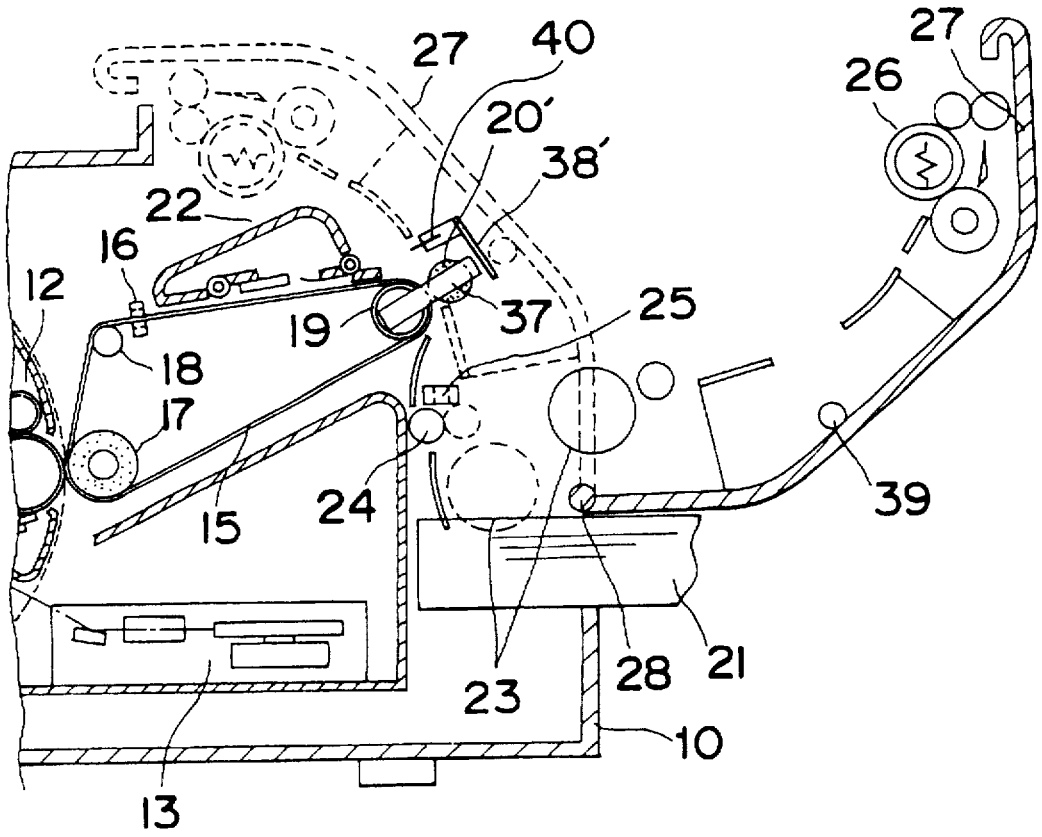
FIG. 8 is a schematic sectional view of a color image forming apparatus of a fifth embodiment of the invention.

FIG. 8 shows a color image forming apparatus of a fifth embodiment of the invention. This apparatus is different from that of the third embodiment shown in FIG. 5 only in that a charge removing needle 40 is arranged at the downstream side along the paper feed path with respect to the transfer region. Dashed lines represent the door 27 in the close position. The charge removing needle 40 is provided to remove charges from a back of a paper sheet supplied by the secondary transfer roller 20'. The charge removing needle 40 comprises a metallic plate of thickness of 0.5 mm, and it is connected to the ground. An end of the charge removing needle 40 opposing the paper feed path has a saw-teeth shape. The end is arranged at a position not in contact with the back face of a paper sheet in the paper feed path, but easy for the removing charges at the back by themselves towards the end of the charge removing needle 40. The end of the charge removing needle 40 is separated by 3 mm at minimum from the paper sheet.

Beside the above-mentioned operation of the charge removing needle 40, it also operates as a cover because when the door 27 is opened, the secondary transfer roller 20' and the charge removing needle 40 are arranged at positions to cover the intermediate transfer belt 15. Further, because the charge removing needle 40 is arranged adjacent to the secondary transfer roller 20', the surface of the belt 15 or a toner image on the belt is covered in a wider area.

In the first and second embodiments, the charge removing needle 40 is fixed to the door 27, and it is arranged with reference to the hinge for rotating the door 27. Thus, if the precision of the hinge is low or the hinge is set not so precisely along the right and left direction, the position of the charge removing needle 40 becomes nonuniform along the longitudinal direction thereof. Then, an amount of charges to be removed is liable to become uneven along the longitudinal direction, and if there remain charges at the back of the paper sheet, a nonuniform force of electrostatic absorption is exerted to the paper sheet, and this may cause to skew the paper sheet or to adhere it to the belt 15 to cause a paper jam. Further, as the door 27 is closed repeatedly, the hinge wears to worsen the accuracy. On the other hand, in the embodiment, the charge removing needle 40 is fixed with reference to the position of the intermediate transfer belt 15. Therefore, the charge removing needle 40 is separated uniformly from the paper sheet along the longitudinal direction. Thus, the above-mentioned disadvantages are prevented.

Figure 9:
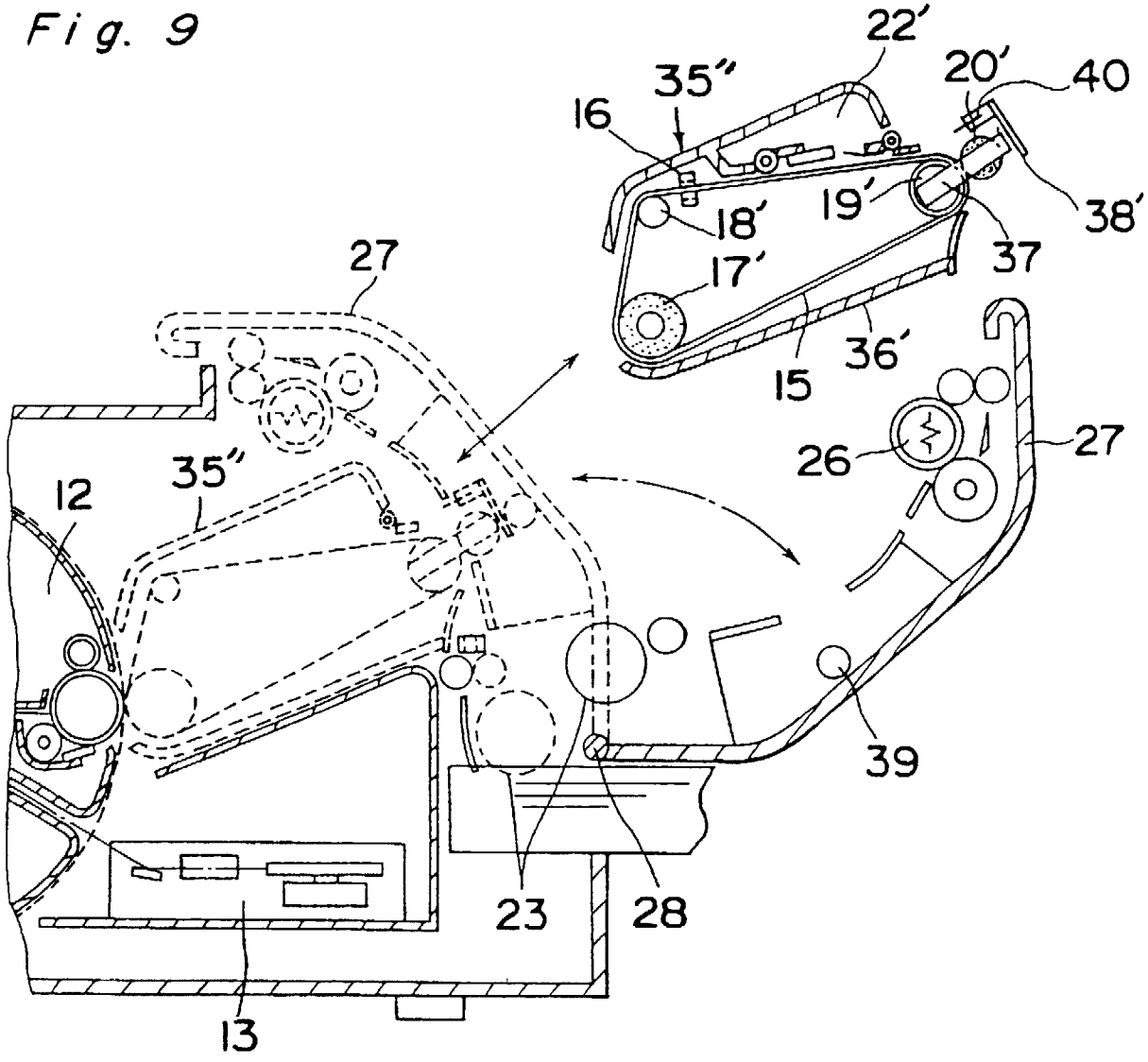
FIG. 9 is a schematic sectional view of an intermediate transfer unit of a sixth embodiment of the invention.

Further, in a sixth embodiment as shown in FIG. 9, the intermediate transfer unit 35" detachable from the main body of the image forming apparatus have the charge removing needle 40. The intermediate transfer unit 35" is the same as that 35' shown in FIG. 7 except that the charge removing needle 40 is fixed to the holder base 38' in the downstream side with respect to the transfer region. Thus, the charge removing needle 40 operates as a cover because when the door 27 is closed, and the secondary transfer roller 20', the holder base 38' and the charge removing needle 40 are arranged at positions to cover the intermediate transfer belt 15. Further, even if a load is applied to the holder base 38', the secondary transfer roller 20' first contacts with the intermediate transfer belt 15, and the charge removing needle 40 does not contact with the belt 15. Thus, the charge removing needle 40 does not damage the belt 15. Further, it becomes easier for maintenance to change the charge removing needle 40, the intermediate transfer belt 15 or the secondary transfer roller 20'.

In the above-mentioned embodiments, the sensor 25 is provided in the paper feed path from the timing rollers 24 to the transfer region. However, it may be provided in the upstream side of the paper feed path with respect to the timing rollers 24. The sensor 25 may be a pick up sensor for detecting a pick up of a paper sheet from the paper feed tray.

It is preferable that a paper sheet is carried from the tray to the timing rollers 24 before a toner image is started to be formed in the image forming unit 12. By providing the sensor 25 between the tray and the timing rollers 24, it can be detected before a toner image is started to be formed that a paper sheet is picked up normally. If a paper sheet is detected not to be picked up normally, formation of the toner image is stopped to be started. Thus, toners are prevented to be consumed wastefully.

A photoconductor forming the photoreceptive drum 121 may be made of zinc oxide, selenium, cadmium sulfide, amorphous silicon or the like beside the organic photoconductor. The charging roller 122 is used in the above-mentioned embodiments for charging the photoreceptive drum 122, any charger such as a charging corotron, a charging scorotron or a fur brush which charges the surface of the photoreceptive drum 121 uniformly may also be used. Various types of toners may be used for forming toner images. The development device is not limited to two-components development device made of toners and carriers.

In the above-mentioned embodiments, toner images of four colors are formed by using four image forming units 12. Then, a group of a photoreceptive drum, a development device and a cleaning device can be changed at once, and maintenance is easy. Further, if the intermediate transfer unit 12 detachable from the main part of the image forming apparatus is used, the unit can also be detached through an opening for removing the image forming unit 12. Thus, a structure of the apparatus becomes simple, and a user is not dismayed to determine which door has to be opened for maintenance. However, in a different way, development devices of four colors may be arranged around a single photoreceptive drum.

The intermediate transfer belt 15 is made of a material having a specific resistivity of preferably $10^6$–$10^{12}$ Ω.cm, or more preferably $10^8$–$10^{10}$ Ω.cm. If the resistivity is less than the lower limit, the transfer efficiency becomes lower, while if it is higher than the upper limit, toner particles forming toner images on the belt are scattered on the belt so that the belt has excess of charges. The intermediate transfer belt 15 may comprise an insulating base of polyethylene terephthalate or the like to which an electrically conductive layer is applied.

A power source for the primary transfer roller 17 may supply a constant direct voltage or a constant direct current. The transfer voltage applied to the secondary transfer roller 20, 20' may be controlled according to the environment such as humidity and temperature.

A cleaning mode may be provided to remove contaminants at the back face of paper sheet while an image is not formed by applying a constant voltage or a constant current of the same polarity of toners to the secondary transfer roller 20, 20'.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus, comprising:

a photoreceptor on which an electrostatic latent image is formed;

a development member for forming a toner image on said photoreceptor;

an intermediate transfer member on which the toner image developed by said development member is transferred;

a first transfer member which transfers the toner image held on said photoreceptor onto said intermediate transfer member;

a paper feed system which feeds a paper sheet to a position where the toner image held on said intermediate member is transferred onto the paper sheet;

a case containing said photoreceptor, said development member, said intermediate transfer member, said first transfer member and said paper feed system, said case having an opening for clearing a paper sheet jammed in a path through which the paper sheet is carried;

a door which closes the opening of said case;

a cover for covering a portion of said intermediate transfer member which is exposed to the opening of said case when said door is opened;

a member, engaged with said door, for moving said cover to cover the portion of said intermediate transfer member exposed to the opening when said door is opened and for retracting said cover from the portion when said door is closed;

a second transfer member which transfers the toner image held on said intermediate transfer member onto the paper sheet fed by said paper feed system and is positioned inside said door, wherein said second transfer member takes a first position to contact via the paper sheet to said intermediate transfer member when the toner image is transferred onto the paper sheet while said door is closed, a second position separated from said intermediate transfer member when the toner image is not transferred onto the paper sheet while said door is closed, or a third position to be separated from said intermediate transfer member by a distance larger than that in the second position while said door is opened;

a cleaning member which eliminates toners remaining on said intermediate transfer member after the toner image is transferred onto the paper sheet by said second transfer member, wherein said cleaning member takes a sixth position to contact with said intermediate transfer member for a predetermined time and a fifth position not in contact with said intermediate transfer member while the toner image is transferred onto said intermediate transfer member; and a paper jam sensor positioned in an upstream side in said paper feed system with respect to said second transfer member and detecting the existence of a jammed paper sheet in a paper feed path, wherein said second transfer member takes the second position and said cleaning member takes the fifth position when said paper jam sensor detects a jammed paper sheet, whereby the toner image held on said intermediate transfer member is not disturbed, and said second transfer member takes the third position when said door is opened, and after said door is closed again, an operation for forming the toner image is continued onto the toner image which has not been disturbed.

2. The apparatus according to claim 1, wherein said intermediate transfer member, said cover and said member for moving and retracting said cover are integrated as a detachable unit which can be detached through said opening of said case.

3. An image forming apparatus, comprising:

a photoreceptor on which an electrostatic latent image is formed;

a development member for forming a toner image on said photoreceptor;

an intermediate transfer member on which the toner image developed by said development member is transferred;

a first transfer member which transfers the toner image held on said photoreceptor onto the intermediate transfer member;

a second transfer member which transfers the toner image held on said intermediate transfer member onto a paper sheet;

a paper feed system which feeds the paper sheet through a path between said intermediate transfer member and said second transfer member;

a case containing said photoreceptor, said development member, said intermediate transfer member, said first transfer member, said second transfer member and said paper feed system, said case having an opening for removing a jammed paper sheet in said paper feed system;

a door which closes the opening of said case; and a member engaging with said door when said door is closed and separating said second transfer member from said intermediate transfer member when said door is opened;

wherein said second transfer member takes a first position to contact via the paper sheet with said intermediate transfer member when the toner image held on said intermediate transfer member is transferred to the paper sheet while the door is closed and, takes a second position separated from said intermediate transfer member when the toner image held on said photoreceptor is transferred to said intermediate transfer member while the door is closed, and takes the second position while the door is opened whereby a portion of said intermediate transfer member exposed to the opening of said door is covered by said second transfer member while said door is opened.

4. The apparatus according to claim 3, wherein said intermediate transfer member, said second transfer member and said member separating said second transfer member are integrated as a detachable unit which can be detached through the opening of said case.

5. The image forming apparatus according to claim 3, further comprising a charge removing member supported by said member separating said second transfer member, said charge removing member being provided at a downstream side along the paper feed path of said paper feed system.

6. The apparatus according to claim 5, wherein said intermediate transfer member, said second transfer member, said charge removing member and said member separating said second transfer member are integrated as a detachable unit which can be detached through the opening of said case.

7. The image forming apparatus according to claim 3, further comprising:

a cleaning member for eliminating toners, wherein said cleaning member takes a third position contacting said intermediate transfer member to eliminate toners remaining thereon while the toner image on said intermediate member is transferred to a paper sheet and a fourth position not contacting said intermediate transfer member while the toner image is transferred onto said intermediate transfer member;

a paper jam sensor positioned in an upstream side in said paper feed system with respect to said second transfer member and detecting the existence of a jammed paper sheet in a paper feed path, wherein said second transfer member takes the second position and said cleaning member takes the fourth position when said paper jam sensor detects the jammed paper sheet, whereby the toner image held on said intermediate transfer member is not disturbed while said door is opened, and after said door is closed again, an operation for forming the toner image is continued onto the toner image which has not been disturbed.

8. The apparatus according to claim 7, wherein said intermediate transfer member, said second transfer member and said member separating said second transfer member are integrated as a detachable unit which can be detached through said opening of said case.

9. The image forming apparatus according to claim 7, further comprising a charge removing member supported by said member separating said second transfer member, said charge removing member being provided at a downstream side along the paper feed path of said paper feed system.

10. The apparatus according to claim 7, wherein said intermediate transfer member, said second transfer member, said charge removing member and said member separating said second transfer member are integrated as a detachable unit which can be detached through said opening of said case.

11. An intermediate transfer unit detachable from a main part of an image forming apparatus through an opening of a case of the apparatus for clearing paper jams, the opening being closed with a door, said intermediate transfer unit comprising:

an intermediate transfer member on which a toner image is transferred;

a transfer member which transfers the toner image onto said intermediate transfer member;

an intermediate transfer unit case containing said intermediate transfer member and said transfer member and having a portion wherein said intermediate transfer member is exposed to the exterior of said intermediate transfer unit case;

a second transfer member which transfers the toner image held on said intermediate transfer member onto a paper sheet; and a member connected to said case, said member engaging said door when said door is closed, the member separating said second transfer member from said intermediate transfer member when said door is opened, wherein when said intermediate transfer unit is detached, said second transfer member takes a position near said portion of said case to cover said intermediate transfer member with a gap remaining between said second transfer member and said intermediate transfer member.

12. The image forming unit according to claim 11, further comprising a charge removing member for removing charges from a back of a paper sheet, said charge removing member being supported by said member separating said second transfer member at a downstream side of a paper feed path of the paper sheet in the image forming apparatus with respect to said second transfer member.

13. The image forming unit according to claim 11, further comprising a cleaning member for eliminating toners, wherein said cleaning member takes a first position contacting said intermediate transfer member to eliminate toners remaining thereon while the toner image on said intermediate member is transferred to a paper sheet and a second position not contacting said intermediate transfer member while the toner image is transferred onto said intermediate transfer member.

14. An intermediate transfer unit detachable from a main part of an image forming apparatus through an opening of a case of the apparatus for clearing paper jams, the opening being closed with a door, said intermediate transfer unit comprising:

an intermediate transfer member on which a toner image is transferred;

a transfer member which transfers the toner image onto said intermediate transfer member;

an intermediate transfer unit case containing said intermediate transfer member and said transfer member and having a portion wherein said intermediate transfer member is exposed to the exterior of said intermediate transfer unit case;

a second transfer member which transfers the toner image held on said intermediate transfer member onto a paper sheet;

a member connected to said case, said member engaging said door when said door is closed, the member separating said second transfer member from said intermediate transfer member when said door is opened; and a charge removing member for removing charges from a back of a paper sheet, said charge removing member being supported by said member separating said second transfer member at a downstream side of a paper feed path of the paper sheet in the image forming apparatus with respect to said second transfer member.

15. The image forming unit according to claim 14, further comprising a cleaning member for eliminating toners, wherein said cleaning member takes a first position contacting said intermediate transfer member to eliminate toners remaining thereon while the toner image on said intermediate member is transferred to a paper sheet and a second position not contacting said intermediate transfer member while the toner image is transferred onto said intermediate transfer member.

* * * * *